US006257256B1

(12) United States Patent
Fischer

(10) Patent No.: US 6,257,256 B1
(45) Date of Patent: Jul. 10, 2001

(54) APPARATUS FOR CLEANING ROOF GUTTERS

(76) Inventor: Joseph E. Fischer, 4554 Overland Pkwy., Toledo, OH (US) 43612

( * ) Notice: Subject to any disclaimer, the term of this patent is extended or adjusted under 35 U.S.C. 154(b) by 0 days.

(21) Appl. No.: 09/307,303

(22) Filed: May 7, 1999

Related U.S. Application Data

(60) Provisional application No. 60/084,979, filed on May 11, 1998.

(51) Int. Cl.[7] ..... B08B 9/02

(52) U.S. Cl. ..... 134/167 R; 134/167 C; 134/166 C

(58) Field of Search ..... 134/166 R, 167 R, 134/168 C, 167 C, 169 C, 166 C, 169 R; 15/236.04; 52/11, 16; 239/281, 532

(56) References Cited

U.S. PATENT DOCUMENTS

| | | | | |
|---|---|---|---|---|
| 2,817,867 | | 12/1957 | Bugbird . | |
| 2,896,239 | | 7/1959 | Bugbird . | |
| 3,023,971 | | 3/1962 | Milhous . | |
| 3,041,655 | | 7/1962 | Entler . | |
| 3,626,542 | | 12/1971 | Despain et al. . | |
| 4,304,498 | * | 12/1981 | George | 134/167 C |
| 4,349,039 | * | 9/1982 | Egger | 134/167 C |
| 4,363,335 | * | 12/1982 | Tapper | 134/167 C |
| 4,447,927 | | 5/1984 | Malless, Jr. . | |
| 4,750,883 | * | 6/1988 | Drake | 134/167 C |
| 5,022,586 | * | 6/1991 | Putman | 134/167 C |
| 5,037,028 | * | 8/1991 | Evans . | |
| 5,390,853 | * | 2/1995 | Ellul . | |
| 5,573,024 | * | 11/1996 | Devaney et al. | 134/167 R |
| 5,725,322 | * | 3/1998 | Evans . | |
| 5,727,580 | * | 3/1998 | Patterson | 134/167 R |
| 5,875,590 | * | 3/1999 | Udelle . | |
| 5,947,388 | * | 9/1999 | Woodruff . | |
| 5,966,847 | * | 10/1999 | Nathenson et al. . | |

* cited by examiner

*Primary Examiner*—Frankie L. Stinson
(74) *Attorney, Agent, or Firm*—Donald R. Fraser

(57) ABSTRACT

An apparatus for cleaning roof gutters having a cleaning mechanism pivotally mounted to the distal end of a height adjustable supporting pole.

12 Claims, 3 Drawing Sheets

APPARATUS FOR CLEANING ROOF GUTTERS

This is a continuation of provisional patent application Ser. No. 60/084,979 filed May 11, 1998.

FIELD OF THE INVENTION

This invention relates to an apparatus for cleaning roof gutters. More particularly, the invention is directed to an apparatus for cleaning roof gutters with a pivotal cleaning mechanism for the safe and easy positioning of the user and a telescoping pole to provide adjustment for reaching gutters of varying heights.

BACKGROUND OF THE INVENTION

The present invention relates generally to an apparatus for cleaning debris from roof gutters adapted to be manually operated by a person standing on the ground.

Leaves, twigs, and other debris tends to collect in the roof gutters of homes and other buildings, and if not periodically removed, accumulate to the point of interfering with the drainage of the gutter. The interference with drainage can result in overflowing of the gutter and damage to the gutter or roof of the home or other building. This problem may become particularly acute when the debris is matted down or compacted, such that it can clog the downspouts, and is particularly difficult to remove.

In order to remove the debris that collects in a gutter, the home owner must use a ladder placed alongside the gutter; or must climb onto the roof, and then proceed to clean the gutter. This procedure is laborious, time consuming, and dangerous.

It has been proposed to provide implements for cleaning gutters by a person standing on the ground. Frequently, these devices have required that the user perform manipulative steps in order to remove the debris from the gutter, which manipulation requires some skill and previous experience in operating the implement to do an effective job. In addition, adjustment to the length of these other implements requires the user to break apart the implement and add or remove sections which is both time consuming and cumbersome. These other implements have also utilized fixed position or manually adjustable cleaning tools requiring time-consuming adjustments if obstructions require the user to change their distance from the building of which they are cleaning the gutters. Other implements have also been found to be less than satisfactory in removing leaves or other debris which has become matted down or compacted within the gutter.

It would be desirable to produce an apparatus for cleaning roof gutters or the like which overcomes the above-mentioned drawbacks of known prior-art cleaning implements.

It is an object of the present invention to produce an apparatus for removing leaves and other debris from roof gutters for use by a person standing on the ground that is easy to use, and requires a minimum of skill and little or no previous experience.

Another object of the present invention is to produce an apparatus for cleaning roof gutters that utilizes a quick and easy length adjustment method. This provides flexibility to the user to reach gutters of varying heights, as well as facilitating compact storage of the apparatus in a ready to use condition.

Still another object of the present invention is to produce an apparatus for cleaning roof gutters that facilitates safe and easy positioning of the user from the house or other building through the use of a pivotal cleaning tool. The use of a pivotal cleaning tool also allows the user to work around any obstructions without having to make time consuming adjustments.

It is further an object of this invention to provide an apparatus for removing leaves and other debris, including matted down material, from roof gutters by a person on the ground that is lightweight, durable, and is economical to manufacture.

SUMMARY OF THE INVENTION

The above as well as other objects and advantages of the present invention may be readily achieved by an apparatus for cleaning roof gutters including a pivotal cleaning tool and telescoping pole. An apparatus, which is light weight, durable and is simple and economical to manufacture, has surprisingly been discovered. The apparatus for cleaning roof gutters comprises:

- an elongate supporting pole, the pole being formed of at least one hollow member being a proximal and a distal end;
- a fork-like member for insertion into the roof gutter to be cleaned that is pivotally mounted to the distal end of the supporting pole; and
- a hose for conveying water under pressure from the proximal end of the pole to be emitted at the distal end of the pole whereby the fork-like member can be moved along the roof gutter by the pole and the pole can be pivoted toward and away from the gutter to permit the water emitted from the distal end of the pole and the fork-like member to remove debris from the gutter.

The apparatus for cleaning roof gutters is particularly useful for cleaning gutters of the type typically used for residential housing.

BRIEF DESCRIPTION OF THE DRAWINGS

The above, as well as other objects and advantages will be readily understood by those skilled in the art from reading the following detailed description of an embodiment of the invention when considered in the light of the accompanying drawings, in which.

DETAILED DESCRIPTION OF THE PREFERRED EMBODIMENT OF THE INVENTION

Figure 1:
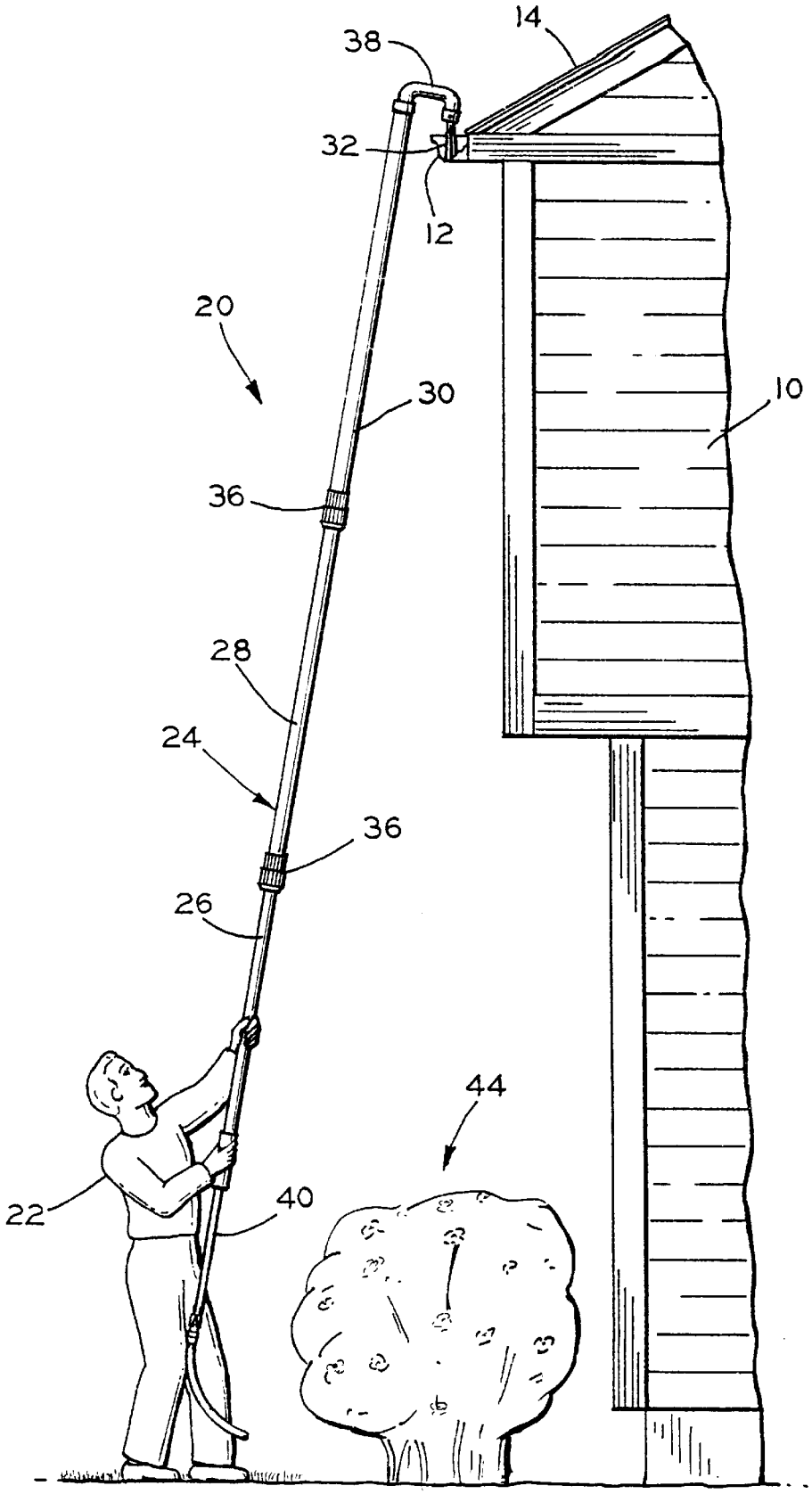
FIG. 1 is an elevational view with portions thereof cut-away showing apparatus containing the features of the present invention being utilized in cleaning the gutters for the roof of a house overhanging the second story thereof.

Referring to the drawings, there is shown in FIG. 1 a house 10 having a generally horizontally extending gutter 12 installed beneath the lower edge or eave of a roof 14. The gutter 12 typically communicates with a down spout (not shown) for conveying the rain water from the gutter 12.

An apparatus, generally designated by reference numeral 20, constructed in accordance with the invention, is illustrated in an operative position and being held therein by a person 22 standing on the ground below the gutter 12. The apparatus 20 includes an elongate hollow pole 24 comprised of a plurality of hollow segments 26, 28, and 30. The respective diameters of the hollow segments 26, 28, and 30 progressively decrease from the proximal to the distal end of the hollow pole 24. This decrease of diameters in the hollow segments 26, 28, and 30 facilitates the telescoping of the hollow segments 26, 28, and 30 allowing incremental adjustment of the overall length of the hollow pole 24.

The hollow segments 26, 28, and 30 are adjustably fitted together using telescoping threaded couplers 36. The telescoping threaded couplers 36 can be threadably loosened or tightened around the hollow segments 26, 28, and 30 to facilitate incremental adjustment in the overall length of the hollow pole 24. The overall length of the pole 24 is determined by the height of the gutter being serviced.

The hollow segments 26, 28, and 30 can be formed of any conventional lightweight and durable materials such as, for example, metals (e.g. aluminum) or thermal plastics (e.g. polyvinyl chloride).

A generally U-shaped hollow segment 38 is suitably attached to the distal end of the highest hollow segment 30. The proximal end of the U-shaped component 38 is attached to the free end of the segment 30, while the distal end thereof is provided with a pivotally mounted fork-like member 32. The U-shaped hollow segment 38 can be formed of any conventional lightweight and durable materials such as, for example, metals (e.g. aluminum) or thermal plastics (e.g. polyvinyl chloride).

Figure 3:
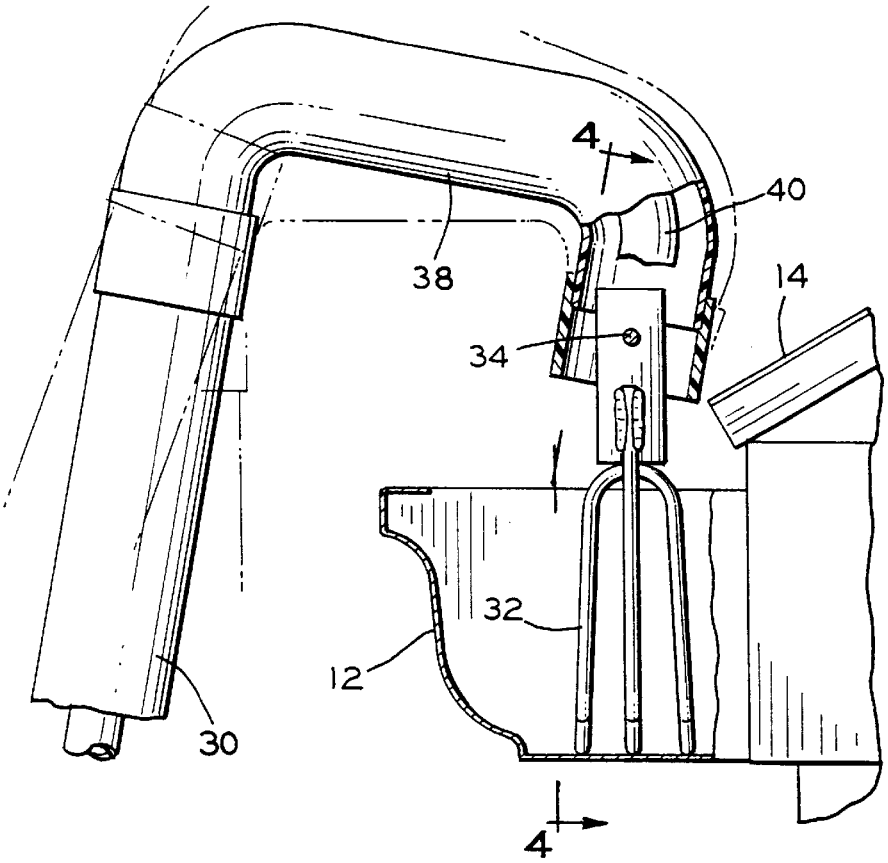
FIG. 3 is an enlarged fragmentary view partially in section illustrating the distal end of the apparatus disposed in the gutter in operative position as shown in FIG. 1.
Figure 4:
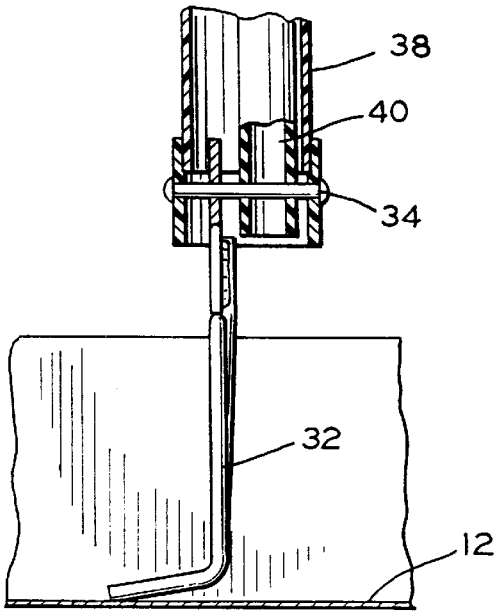
FIG. 4 is a sectional view of the apparatus illustrated in FIG. 3 taken along line 4—4 thereof.

The fork-like member 32 is pivotally affixed to the distal end of the U-shaped component 38 by a pivotal mounting 34, as shown in FIGS. 3 and 4. The pivotal mounting 34 permits pivotal movement of the fork-like member 32 in a plane that is generally perpendicular to the path of travel of the fork-like member 32 as it is moved through the gutter 12 by the hollow pole 24. Accordingly, the tines of the fork-like member 32 are able to slide along the base of the gutter 12 while the pole 24 may be moved toward or away from the building 10 to allow the user to work around any obstructions such as landscaping or building appurtenances, generally designated by reference numeral 44. The fork-like member 32 can be formed of any conventional rigid and durable materials such as, for example, metals (e.g. steel or aluminum) or thermal plastics (e.g. polyvinyl chloride).

Figure 2:
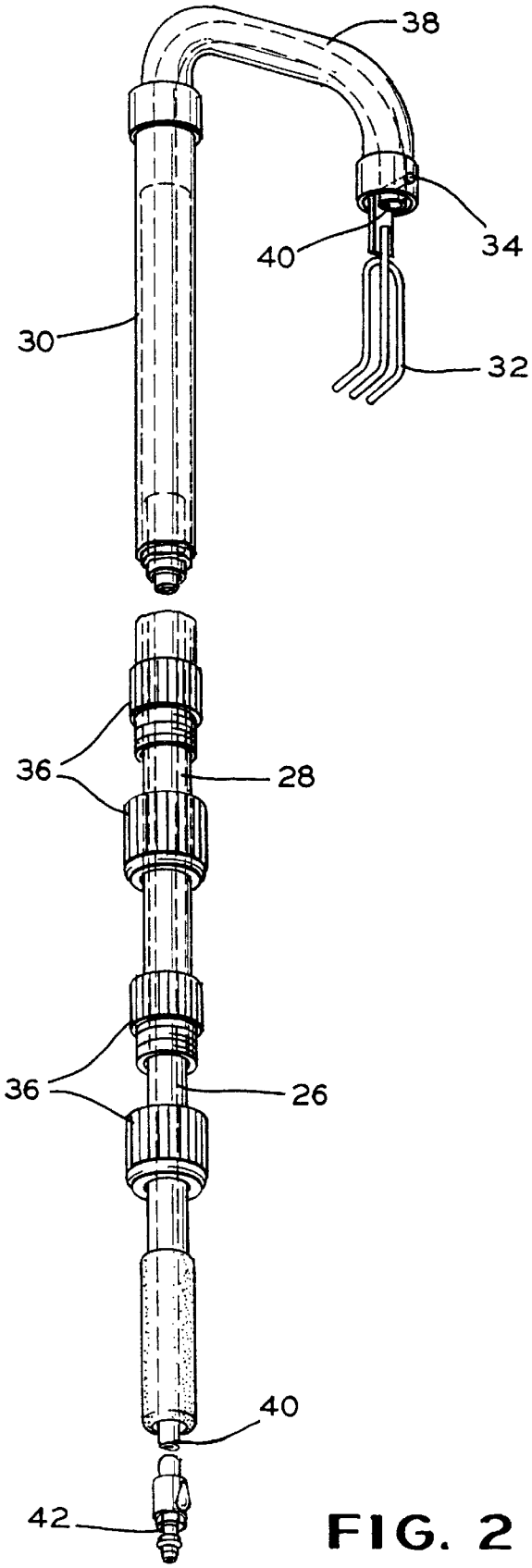
FIG. 2 is a perspective view of the apparatus of the invention, as illustrated in FIG. 1, in its compact or storage configuration.

A water conducting hose 40 is adapted to extend completely through the length of the interior of the pole 24 and the associated terminally disposed U-shaped member 38. As is clearly apparent from FIGS. 2 and 3, the outlet of the hose 40 is positioned immediately above the fork-like member 32. Therefore, water, under pressure may be introduced into the inlet end 42 of the hose 40 and is caused to be discharged adjacent to the fork-like member 32 to assist in the removal of any debris in the gutter 12. Manifestly, the manipulation of any debris by the fork-like member 32 assisted by the pressure of the fluid emitted from the hose 40 will effectively facilitate removal of debris from the gutter 12.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An apparatus for cleaning roof gutters comprising:

an elongate supporting pole, said pole being formed of at least one hollow member, there being a proximal and a distal end;

a fork-like member for insertion into the roof gutter to be cleaned that is freely pivoted to the distal end of said supporting pole; and a hose for conveying water under pressure from the proximal end of said pole to be emitted at the distal end of said pole whereby said fork-like member can be moved along the roof gutter by said pole and said pole can be pivoted toward and away from the gutter to permit the water emitted from the distal end of said pole and said fork-like member to remove debris from the gutter.

2. The apparatus for cleaning roof gutters according to claim 1, wherein said pole is formed of a plurality of hollow members where the diameters of the hollow members facilitate the sliding engagement of the hollow members such that the overall length of said supporting pole can be adjusted by the telescoping of the hollow members.

3. The apparatus for cleaning roof gutters according to claim 2, wherein said hollow members are adjustably fitted together using telescoping threaded couplers.

4. The apparatus for cleaning roof gutters according to claim 2, wherein said hollow members are formed of aluminum.

5. The apparatus for cleaning roof gutters according to claim 2, wherein said hollow members are formed of polyvinyl chloride.

6. An apparatus for cleaning roof gutters including:

an elongate supporting pole, said pole being formed of a plurality of hollow members where the diameters of the hollow members facilitate the sliding engagement of the hollow members such that the overall length of said pole can be adjusted by the telescoping of the hollow members, there being a proximal and a distal end;

a fork-like member for insertion into the roof gutter to be cleaned, said member being freely pivoted to the distal end of said supporting pole; and a hose for conveying water under pressure from the proximal end of said pole to be emitted at the distal end of said pole whereby said fork-like member can be moved along the roof gutter by said pole and said pole can be pivoted toward and away from the gutter to permit the water emitted from the distal end of said pole and said fork-like member to remove debris from the gutter.

7. The apparatus for cleaning roof gutters according to claim 6, wherein the hollow members of said pole are adjustably fitted together by telescoping threaded couplers.

8. The apparatus for cleaning roof gutters according to claim 6, wherein the hollow members of said pole are formed of aluminum.

9. The apparatus for cleaning roof gutters according to claim 6, wherein the hollow members of said pole are formed of polyvinyl chloride.

10. An apparatus for cleaning roof gutters including:

an elongate supporting pole, said pole being formed of a plurality of hollow members where the diameters of the hollow members facilitate the sliding engagement of the hollow members such that the overall length of said pole can be adjusted by the telescoping of the hollow members and the hollow members are adjustably fitted together using telescoping threaded couplers that are threadably loosened and tightened around the hollow segments to facilitate incremental adjustment in the overall length of said pole, there being a proximal and a distal end;

a fork-like member for insertion into the roof gutter to be cleaned, said member being freely pivoted to the distal end of said supporting pole; and a hose for conveying water under pressure from the proximal end of said pole to be emitted at the distal end of said pole whereby said fork-like member can be moved along the roof gutter by said pole and said pole can be pivoted toward and away from the gutter to permit the water emitted from the distal end of said pole and said fork-like member to remove debris from the gutter.

11. The apparatus for cleaning roof gutters according to claim 10, wherein the hollow members of said pole are formed of aluminum.

12. The apparatus for cleaning roof gutters according to claim 10, wherein the hollow members of said pole are formed of polyvinyl chloride.

* * * * *